US010389033B2

(12) United States Patent
Morgan et al.

(10) Patent No.: US 10,389,033 B2
(45) Date of Patent: Aug. 20, 2019

(54) HIGH GAIN, CONSTANT BEAMWIDTH, BROADBAND HORN ANTENNA

(71) Applicant: THE BOEING COMPANY, Chicago, IL (US)

(72) Inventors: Douglas P. Morgan, Chicago, IL (US); Baird E. Perry, Chicago, IL (US)

(73) Assignee: The Boeing Company, Chicago, IL (US)

( * ) Notice: Subject to any disclaimer, the term of this patent is extended or adjusted under 35 U.S.C. 154(b) by 41 days.

(21) Appl. No.: 15/343,573

(22) Filed: Nov. 4, 2016

(65) Prior Publication Data

US 2018/0131098 A1 May 10, 2018

(51) Int. Cl.

| | |
|---|---|
| ***H01Q 13/02*** | (2006.01) |
| ***H01Q 15/16*** | (2006.01) |
| ***H01Q 1/28*** | (2006.01) |
| ***H01Q 17/00*** | (2006.01) |
| ***H01Q 5/55*** | (2015.01) |
| *H01Q 19/13* | (2006.01) |

(52) U.S. Cl.
CPC ..... *H01Q 13/02* (2013.01); *H01Q 1/288* (2013.01); *H01Q 5/55* (2015.01); *H01Q 15/16* (2013.01); *H01Q 17/001* (2013.01); *H01Q 17/008* (2013.01); *H01Q 19/132* (2013.01)

(58) Field of Classification Search
CPC ..... H01Q 13/02; H01Q 15/16; H01Q 3/24; H01Q 7/00; H01Q 13/106; H01Q 9/065; H01Q 17/001; H01Q 17/008; H01Q 5/55; H01Q 1/288; H01Q 19/132; H04L 5/006
See application file for complete search history.

(56) References Cited

U.S. PATENT DOCUMENTS 2,650,985 A * 9/1953 Rust ..... H01Q 13/02 333/248
3,514,781 A 5/1970 Ferris et al.
3,530,481 A * 9/1970 Tanaka ..... H01Q 13/0208 343/786
3,573,838 A * 4/1971 Ajioka ..... H01Q 13/025 343/783
4,141,015 A 2/1979 Wong et al.
5,317,328 A 5/1994 Allen
(Continued)

OTHER PUBLICATIONS

Walton, Kenneth L. et al., Constant-Beamwidth Antenna Development, IEEE Transactions of Antennas and Propagation, vol. AO-16, No. 5, Sep. 1968 (4pgs).

(Continued)

*Primary Examiner* — Hai V Tran
*Assistant Examiner* — Michael M Bouizza
(74) *Attorney, Agent, or Firm* — Haynes and Boone LLP

(57) ABSTRACT

A horn antenna comprises an electrically conductive shell having an inner surface, a cavity formed in the shell, an aperture defined at one end of the cavity, a throat section coupled to the electrically conductive shell in communication with another end of the cavity opposite the aperture, and a spatially and frequency dependent radio frequency (RF) attenuator disposed within the cavity, such that an attenuation of RF energy propagating through the cavity between the throat section and the aperture more rapidly increases in an outward direction towards the inner surface of the electrically conductive shell as the frequency of the RF energy increases.

20 Claims, 6 Drawing Sheets

(56) References Cited

U.S. PATENT DOCUMENTS

| | | | | |
|---|---|---|---|---|
| 6,611,238 | B1 * | 8/2003 | Santoru | H01Q 13/02 343/786 |
| 6,759,995 | B1 | 7/2004 | Speece | |
| 6,879,298 | B1 | 4/2005 | Zarro et al. | |
| 2007/0052608 | A1 * | 3/2007 | Stafford | H01Q 13/0208 343/786 |

OTHER PUBLICATIONS

Salleh et al., "Chebyshev Multi-Layer Microwave Absorber Design", 2013 IEEE International RF and Microwave Conference, Dec. 9-11, 2013, pp. 306-309, Penang, Malaysia.

Tan et al., "A Dielectric-Loaded Long Conical Horn for Improved Performance", Microwave Conference, Dec. 7, 2009, pp. 1767-1770, Piscataway, New Jersey.

* cited by examiner

HIGH GAIN, CONSTANT BEAMWIDTH, BROADBAND HORN ANTENNA

FIELD

The present disclosure generally relates to high gain antennas, and more particularly, horn antennas.

BACKGROUND

There are generally two types of aperture antennas. The first type of aperture antenna is a horn antenna that is typically included with a cluster or array for directly transmitting and/or receiving radio frequency (RF) signals. The second type of aperture antenna is a reflector antenna, which generally includes a parabolic reflector complemented by one or more feed horns for transmitting and/or receiving RF signals.

It is beneficial that the beamwidth of an aperture antenna, especially in space applications, be as uniform as possible over its operating frequency range, so that the desired radiation pattern produced by the antenna does not substantially vary. A reflector antenna may be modified to produce a constant beamwidth over its operating range by under-illuminating the reflector surface at the higher operating frequencies. The beamwidth of such a modified reflector antenna will be inherently frequency independent due to the self-compensating relationship between the parabolic reflector and feed horn(s), resulting in a substantially uniform beamwidth over its operating frequency range. That is, the significantly oversized reflector surface is fed with a smaller aperture antenna feed. As the beamwidth of the feed antenna decreases with frequency, the illuminated portion of the reflector surface also decrease, causing the effective aperture of the combination to be reduced. This provides an electrical aperture size that is constant with frequency (providing a constant beamwidth). However, under-illuminating the reflector surface results in reflector that is much larger than necessary for the application, which has several disadvantages (increased size, weight, and complexity). Other solutions for providing a constant beamwidth with frequency involve modifications to the reflector surface (either through variable size holes or by using a mesh with variable spacings) to provide reflectivity variations with frequency.

In contrast to this modified reflector antenna, the beamwidth of a horn antenna is frequency-dependent. That is, the beamwidth of a horn antenna is inversely proportional to the electrical aperture size in wavelengths (i.e., larger electrical aperture size translates to smaller beamwidth). For a horn antenna with a fixed physical aperture size, the electrical size in wavelengths increases as the wavelength decreases (i.e., as the frequency is increased). That is, as the frequency of the RF signals increases, the beamwidth decreases, and as the frequency of the RF signals decreases, the beamwidth increases.

While a reflector antenna may be modified to exhibit uniform beamwidth over its operational frequency band, it requires the use of bulky, heavy, and over-sized reflector structures, and therefore may be unsuitable for space applications, suffers from thermal distortion due to the wide variances in temperature in space, and requires a relatively complex manufacturing process. In contrast, a horn antenna is relatively compact and light-weight, is structurally stable, does not suffer from thermal effects, and requires only simple construction and adjustment. However, as can be appreciated from the discussion above, a conventional horn antenna has a beamwidth that is frequency dependent, and due to its broad bandwidth, can exhibit extreme variations in beamwidth over its operational frequency band.

There, thus, remains a need for a constant beamwidth, broad-band, high-gain antenna.

SUMMARY

In accordance with a first aspect of the present disclosure, a horn antenna comprises an electrically conductive shell having an inner surface and a cavity formed in the shell, a cavity formed in the shell, an aperture defined at one end of the cavity, and a throat section coupled to the electrically conductive shell in communication with another end of the cavity opposite the aperture. In one embodiment, the inner surface of the electrically conductive shell is smooth. The electrically conductive shell may be, e.g., conical, or it may be, e.g., pyramidal, sectoral, or profiled.

The horn antenna further comprises a spatially and frequency dependent radio frequency (RF) attenuator disposed within the cavity, such that an attenuation of RF energy propagating through the cavity between the throat section and the aperture more rapidly increases in an outward direction towards the inner surface of the electrically conductive shell as the frequency of the RF energy increases. The RF attenuator may be configured for varying the electrically effective size of the aperture in inverse proportion to a frequency of the RF energy.

In one embodiment, the RF attenuator is composed of RF absorbing material, such that the RF energy impinging on the RF attenuator has a relatively low reflection coefficient. In another embodiment, the RF attenuator is composed of RF reflecting material. The RF attenuator may be composed of commercially available material, e.g., carbon powder loaded polyurethane material. Or, the RF attenuator may be composed of custom-designed meta-material, e.g., a honeycomb core material containing inductive, capacitive, and/or resistive elements. The cross-sections of the horn shell and the RF attenuator along a plane parallel to the aperture may be geometrically similar. The RF attenuator may comprise a hollow center region.

In still another embodiment, the RF attenuator incrementally and discretely increases in attenuation in the outward direction. For example, the RF attenuator may comprise a plurality of discrete regions that are nested in a manner, such that they incrementally increase in attenuation in the outward direction. The discrete regions may, e.g., respectively have different attenuations per unit length, such that the lengths of the discrete regions along a plane perpendicular to the aperture may be equal. Or, the discrete regions may have lengths along a plane perpendicular to the aperture that respectively increase in the outward direction, such that the discrete regions may respectively have the same attenuation per unit length. In yet another embodiment, the RF attenuator continuously increases in attenuation in the outward direction.

The horn antenna may have a beamwidth that is substantially uniform over an operational frequency band. For example, the beamwidth may vary less than 20% over the operational frequency band, which may be, e.g., a bandwidth of at least 10:1. As another example, the beamwidth may vary less than 10% over the operational frequency band, which may be, e.g., a bandwidth of at least 4:1. As still another example, the beamwidth may vary less than 5% over the operational frequency band, which may be, e.g., a bandwidth of at least 2:1. The RF attenuator may decrease a variance of a beamwidth of the horn antenna over an operational frequency band relative to a nominal beamwidth of corresponding horn antenna without the RF attenuator.

In accordance with a second aspect of the present disclosure, a radio frequency (RF) system may comprise the afore-mentioned horn antenna and RF circuitry coupled to the throat section of the horn antenna. The RF circuitry is configured for transmitting the RF energy to the horn antenna and/or receiving RF energy from the horn antenna.

In accordance with a third aspect of the present disclosure, a communications system comprises a structural body (e.g., a structure of a communications satellite), and the RF system mounted to the structural body.

In accordance with a fourth aspect of the present disclosure, a method of manufacturing a horn antenna in accordance with performance requirements defining an operational frequency band and a nominal beamwidth, and a minimum allowable variance from the nominal beamwidth is provided. The method comprises determining an aperture size of the horn antenna exhibiting the nominal beamwidth at a first frequency within the operational frequency band, and fabricating an electrically conductive shell having a cavity and defining an aperture having the selected aperture size. The first frequency may be, e.g., the lowest frequency in the operational frequency band. In one embodiment, the inner surface of the electrically conductive shell is smooth. The electrically conductive shell may be, e.g., conical, or it may be, e.g., pyramidal, sectoral, or profiled.

The method further comprises fabricating an RF attenuator having an attenuation that gradually increases from an innermost region of the RF attenuator to an outermost region of the RF attenuator. The outer periphery of the RF attenuator conforms to an inner surface of the electrically conductive shell. One method further comprises selecting a maximum attenuation relative to a minimum attenuation based on a width of the operational frequency band, in which case, the RF attenuator may have a maximum attenuation at the periphery equal to the selected maximum attenuation. The RF attenuator may be composed of, e.g., RF absorbing material or RF reflecting material. The RF attenuator may comprise a hollow center region.

In one embodiment, the RF attenuator is composed of RF absorbing material, such that the RF energy impinging on the RF attenuator has a relatively low reflection coefficient. In another embodiment, the RF attenuator is composed of RF reflecting material. The RF attenuator may be composed of commercially available material, e.g., carbon powder loaded polyurethane material. Or, the RF attenuator may be composed of custom-designed meta-material, e.g., a honeycomb core material containing inductive, capacitive, and/or resistive elements. The cross-sections of the horn shell and the RF attenuator along a plane parallel to the aperture may be geometrically similar. The RF attenuator may comprise a hollow center region.

In one embodiment, the RF attenuator may be fabricated in manner that the attenuation incrementally and discretely increases in the outward direction. For example, the RF attenuator may be fabricated with a plurality of discrete regions that are nested, such that they incrementally and discretely increase in attenuation in the outward direction. In this case, the method may further comprise selecting a number of the discrete regions based on a width of the operational frequency band. This method may further comprise respectively selecting different attenuation values for the discrete regions, respectively selecting or designing materials having different attenuations per unit length based on the different selected attenuation values, and respectively fabricating the discrete regions from the materials. In this case, the lengths of the discrete regions along a plane perpendicular to the aperture may be equal. Still another method further comprises respectively selecting different attenuation values for the discrete regions, selecting or designing an attenuating material having an attenuation per unit length, respectively computing lengths of the attenuating material based on the different selected attenuation values and the attenuation per unit length of the attenuating material, and respectively fabricating the discrete regions from the attenuating material. The discrete regions may have lengths equal to the computed lengths along a plane perpendicular to the aperture that respectively increase in the outward direction. In this case, the discrete regions may respectively have the same attenuation per unit length.

In yet another embodiment, the RF attenuator continuously increases in attenuation in the outward direction.

The method further comprises affixing the RF attenuator within the cavity of the electrically conductive shell, such that the variance of a nominal beamwidth of the horn antenna over the operational frequency band complies with the minimum allowable variance from the nominal beamwidth. In one embodiment, the RF attenuator is fabricated, such that the electrically effective size of the aperture varies in inverse proportion to frequency.

The horn antenna may have a beamwidth that is substantially uniform over an operational frequency band. For example, the beamwidth may vary less than 20% over the operational frequency band, which may be, e.g., a bandwidth of at least 10:1. As another example, the beamwidth may vary less than 10% over the operational frequency band, which may be, e.g., a bandwidth of at least 4:1. As still another example, the beamwidth may vary less than 5% over the operational frequency band, which may be, e.g., a bandwidth of at least 2:1. The RF attenuator may decrease a variance of a beamwidth of the horn antenna over an operational frequency band relative to a nominal beamwidth of corresponding horn antenna without the RF attenuator.

In one or more embodiments, a horn antenna comprises an electrically conductive shell having an inner surface. The horn further comprises a cavity formed in the shell. Also, the horn comprises an aperture defined at one end of the cavity. Additionally, the horn comprises a throat section coupled to the electrically conductive shell in communication with another end of the cavity opposite the aperture. Further, the horn comprises a spatially and frequency dependent radio frequency (RF) attenuator disposed within the cavity, such that an attenuation of RF energy propagating through the cavity between the throat section and the aperture more rapidly increases in an outward direction towards the inner surface of the electrically conductive shell as the frequency of the RF energy increases.

In at least one embodiment, the inner surface of the electrically conductive shell is smooth. In one or more embodiments, the electrically conductive shell is conical. In some embodiments, the electrically conductive shell is pyramidal, sectoral, or profiled.

In one or more embodiments, the RF attenuator is composed of RF absorbing material, such that the RF energy impinging on the RF attenuator has a relatively low reflection coefficient. In at least one embodiment, the RF attenuator is composed of RF reflecting material.

In at least one embodiment, cross-sections of the horn shell and the RF attenuator along a plane parallel to the aperture are geometrically similar. In some embodiments, the RF attenuator is configured for varying the electrically effective size of the aperture in inverse proportion to a frequency of the RF energy.

In one or more embodiments, the RF attenuator incrementally and discretely increases in attenuation in the outward direction. In some embodiments, the RF attenuator comprises a plurality of discrete regions that are nested in a manner, such that they incrementally increase in attenuation in the outward direction. In at least one embodiment, the discrete regions respectively have different attenuations per unit length. In some embodiments, the lengths of the discrete regions along a plane perpendicular to the aperture are equal. In at least one embodiment, the discrete regions have lengths along a plane perpendicular to the aperture that respectively increase in the outward direction. In one or more embodiments, the discrete regions respectively have the same attenuation per unit length. In some embodiments, the RF attenuator continuously increases in attenuation in the outward direction.

In at least one embodiment, the RF attenuator is composed of commercially available material. In at least one embodiment, the commercially available material is carbon powder loaded polyurethane material. In some embodiments, the RF attenuator is composed of custom-designed meta-material. In one or more embodiments, the meta-material comprises a honey-comb core material containing inductive, capacitive, and/or resistive elements. In at least one embodiment, the RF attenuator comprises a hollow center region.

In one or more embodiments, the horn antenna has a beamwidth that is substantially uniform over an operational frequency band. In at least one embodiment, the beamwidth varies less than 20% over the operational frequency band. In some embodiments, the operational frequency band has a bandwidth of at least 10:1. In one or more embodiments, the beamwidth varies less than 10% percent over the operational frequency band. In at least one embodiment, the operational frequency band has a bandwidth of at least 4:1. In some embodiments, the beamwidth varies less than 5% over the operational frequency band. In at least one embodiment, the operational frequency band has a bandwidth of at least 2:1. In some embodiments, the RF attenuator decreases a variance of a beamwidth of the horn antenna over an operational frequency band relative to a nominal beamwidth of corresponding horn antenna without the RF attenuator.

In at least one embodiment, a radio frequency (RF) system comprises a horn antenna. The horn antenna comprises an electrically conductive shell having an inner surface. The horn antenna further comprises a cavity formed in the shell. The horn antenna also comprises an aperture defined at one end of the cavity. Also, the horn antenna comprises a throat section coupled to the electrically conductive shell in communication with another end of the cavity opposite the aperture. Further, the horn antenna comprises a spatially and frequency dependent radio frequency (RF) attenuator disposed within the cavity, such that an attenuation of RF energy propagating through the cavity between the throat section and the aperture more rapidly increases in an outward direction towards the inner surface of the electrically conductive shell as the frequency of the RF energy increases. Further, the radio frequency (RF) system comprises RF circuitry coupled to the throat section of the horn antenna, the RF circuitry configured for transmitting the RF energy to the horn antenna and/or receiving RF energy from the horn antenna.

In one or more embodiments, a communications system comprises a structural body. The communications system further comprises and RF system mounted to the structural body. In some embodiments, the structural body is a structure of a communications satellite.

In at least one embodiment, a method of manufacturing a horn antenna in accordance with performance requirements defining an operational frequency band and a nominal beamwidth, and a minimum allowable variance from the nominal beamwidth, comprises determining an aperture size of the horn antenna exhibiting the nominal beamwidth at a first frequency within the operational frequency band. The method further comprises fabricating an electrically conductive shell having a cavity and defining an aperture having the selected aperture size. Also, the method comprises fabricating an RF attenuator having an attenuation that gradually increases from an innermost region of the RF attenuator to an outermost region of the RF attenuator, an outer periphery of the RF attenuator conforming to an inner surface of the electrically conductive shell. Further, the method comprises affixing the RF attenuator within the cavity of the electrically conductive shell, such that the variance of a nominal beamwidth of the horn antenna over the operational frequency band complies with the minimum allowable variance from the nominal beamwidth.

In one or more embodiments, the first frequency is the lowest frequency in the operational frequency band. In some embodiments, the method further comprises selecting a maximum attenuation relative to a minimum attenuation based on a width of the operational frequency band, where the RF attenuator has a maximum attenuation at the periphery equal to the selected maximum attenuation.

In at least one embodiment, the RF attenuator is fabricated such that the electrically effective size of the aperture varies in inverse proportion to frequency. In some embodiments, the RF attenuator is fabricated in manner that the attenuation incrementally and discretely increases in the outward direction.

In one or more embodiments, the RF attenuator is fabricated with a plurality of discrete regions that are nested, such that they incrementally and discretely increase in attenuation in the outward direction. In some embodiments, the method further comprises selecting a number of the discrete regions based on a width of the operational frequency band.

In at least one embodiment, the method further comprises respectively selecting different attenuation values for the discrete regions. Also, the method further comprises respectively selecting or designing materials having different attenuations per unit length based on the different selected attenuation values. Further, the method comprises respectively fabricating the discrete regions from the materials.

In one or more embodiments, the lengths of the discrete regions along a plane perpendicular to the aperture are equal.

In at least one embodiment, the method further comprises respectively selecting different attenuation values for the discrete regions. Also, the method further comprises selecting or designing an attenuating material having an attenuation per unit length. In addition, the method further comprises respectively computing lengths of the attenuating material based on the different selected attenuation values and the attenuation per unit length of the attenuating material. Further, the method comprises respectively fabricating the discrete regions from the attenuating material, the discrete regions having lengths equal to the computed lengths along a plane perpendicular to the aperture that respectively increase in the outward direction.

In one or more embodiments, the RF attenuator continuously increases in attenuation in the outward direction.

Other and further aspects and features of the disclosure will be evident from reading the following detailed description of the preferred embodiments, which are intended to illustrate, not limit, the disclosure.

BRIEF DESCRIPTION OF DRAWINGS

The drawings illustrate the design and utility of preferred embodiments of the present disclosure, in which similar elements are referred to by common reference numerals. In order to better appreciate how the above-recited and other advantages and objects of the present disclosure are obtained, a more particular description of the present disclosure briefly described above will be rendered by reference to specific embodiments thereof, which are illustrated in the accompanying drawings. Understanding that these drawings depict only typical embodiments of the disclosure and are not therefore to be considered limiting of its scope, the disclosure will be described and explained with additional specificity and detail through the use of the accompanying drawings in which.

DETAILED DESCRIPTION

Figure 1:
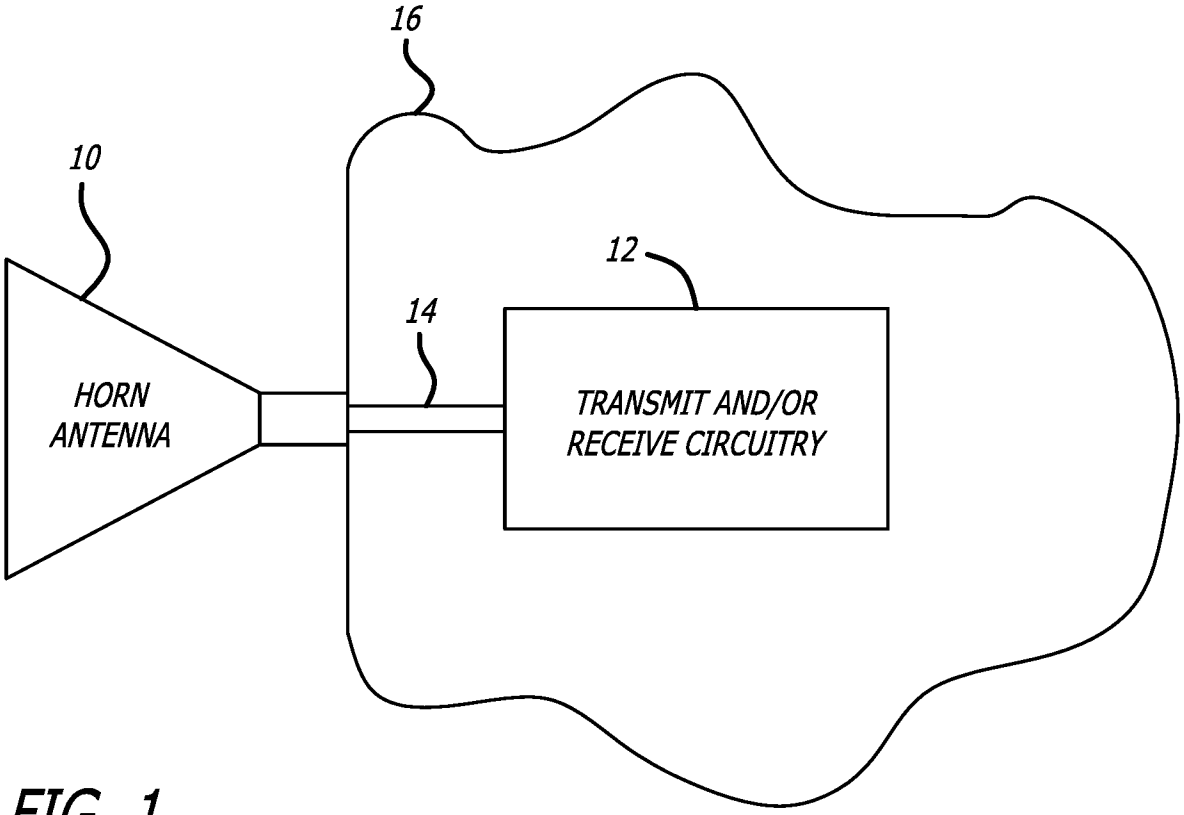
FIG. 1 is a block diagram of a horn antenna constructed in accordance with one embodiment of the present disclosure, wherein the horn antenna is shown incorporated into a satellite communications system.

Referring to FIG. 1, a horn antenna 10*a* constructed in accordance with one embodiment of the present disclosure will now be described. In a conventional manner, the horn antenna 10*a* is coupled to transmit and/or receive circuitry 12 that transmits and/or receives RF signals to and from the horn antenna 10*a* via one or more wave guides 14 and one or more respective ports (not shown). The horn antenna 10*a*, transmit and/or receive circuitry 12, and wave guide(s) 14 form at least a portion of an RF system, such as an RF communications system. In the illustrated embodiment, the horn antenna 10*a* is mounted to the structural body of a structural body of a communications platform, such as a spacecraft 16 (e.g., a communications satellite), and may be used as a single antenna or form part of a larger array of similarly designed horn antennas. For purposes of brevity and illustration, only one horn antenna 10*a* is shown and described. Although the horn antenna 10*a* is described herein as being used in satellite communications, it should be appreciated that the horn antenna 10*a* can be used in other applications, such as radar and laboratory instrumentation.

As is typical with conventional horn antennas, the operational frequency bandwidth (the width of the operational frequency band) of the horn antenna 10*a* may be on the order of 10:1 (e.g., allowing it to operate from 1 GHz to 10 GHz), and can be up to 20:1 (e.g., allowing it to operate from 1 GHz to 20 GHz). As is also typical with conventional horn antennas, the gain of the horn antenna 10*a* may be in the range up to 25 dBi, with 10-20 dBi being typical. Unlike conventional horn antennas, however, the beamwidth of the horn antenna 10*a* is substantially uniform over its operational frequency band without substantially decreasing the gain of the horn antenna 10*a*, thereby providing the same effect as a reflector antenna with respect to having a uniform beamwidth over frequency.

Figure 2:
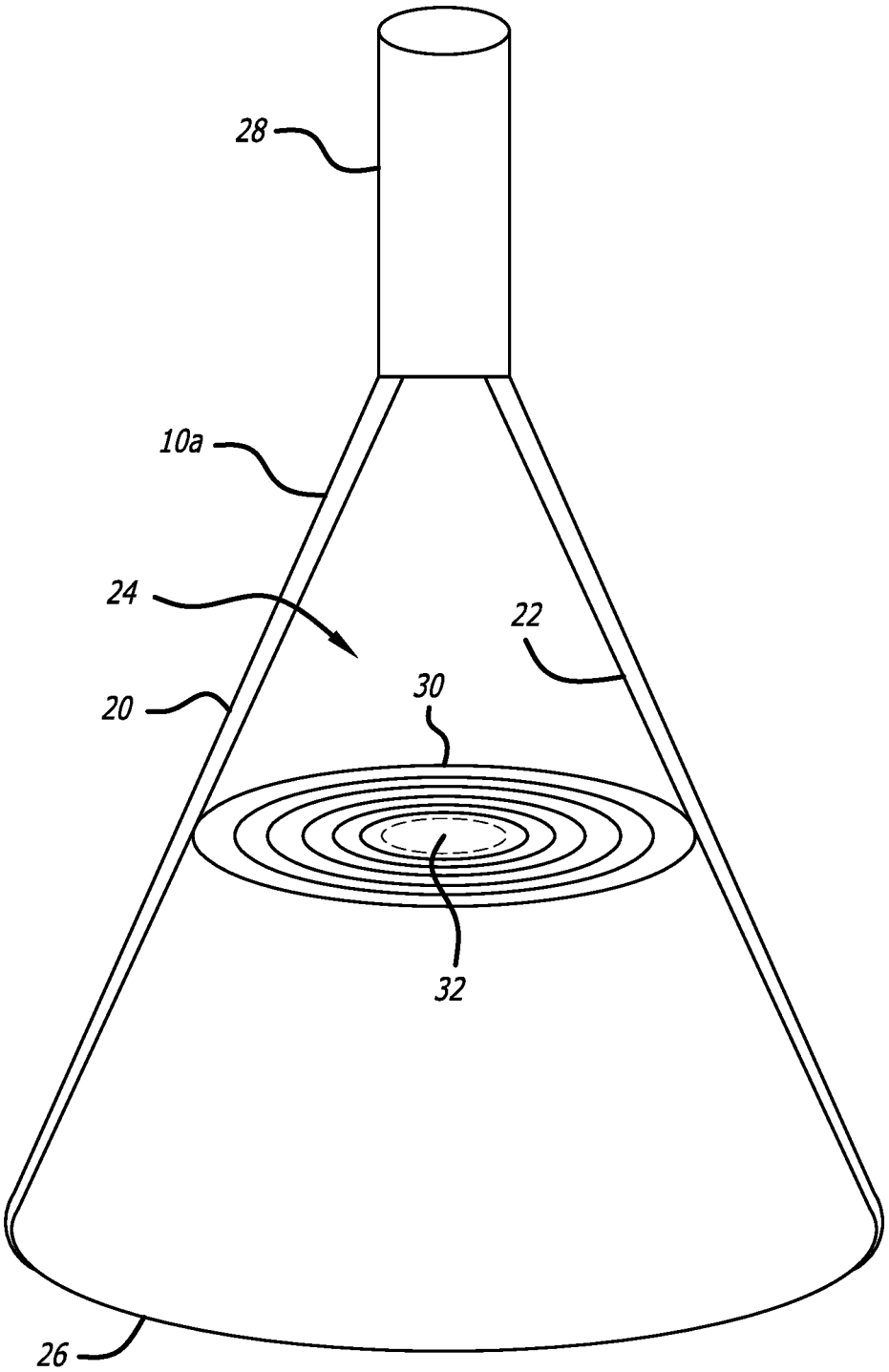
FIG. 2 is a perspective view of the horn antenna of FIG. 1.

To this end, and with further reference to FIG. 2, the horn antenna 10*a* comprising an electrically conductive shell 20 having an inner surface 22, a cavity 24 formed within the horn shell 20, an aperture 26 defined at one end of the cavity 24, and a throat section 28 coupled to the horn shell 20 in communication with the other end of the cavity 24 opposite the horn aperture 26. In the illustrated embodiment, the horn antenna 10*a* takes the form of a conical horn antenna, and thus, the horn shell 20 is likewise conical, while the horn aperture 26 is correspondingly circular. However, in alternative embodiments, the horn antenna 10*a* may take the form of other types, including, but not limited to, a pyramidal horn antenna, a sectoral horn antenna (tapered only in one aperture dimension (E- or H-plane), or a profiled horn antenna.

The throat section 28 has one or more ports (not shown) that the waveguide(s) 14 (illustrated in FIG. 1) are electrically coupled. The waveguide(s) 14 are typically coaxial in nature and are coupled to the one or more ports of the throat section 28 via center conductor pin(s) that extend within the throat section 28. Thus, if the horn antenna 10*a* is used to transmit an RF signal, the RF signal generated by the transmit/receive circuitry 12 may be conveyed through the waveguide(s) 14 and respectively launched into the throat section 28 of the horn antenna 10*a* via the center conductor pins, where the RF signal propagates within the horn cavity 24 and emitted out of the horn aperture 26. In contrast, if the horn antenna 10*a* is used to receive an RF signal, the RF signal is received into the horn aperture 26 of the horn antenna 10*a*, where it is then propagated through the horn cavity 24 into the throat section 28 and conveyed through the waveguides(s) 14 via the center conductor pins to the transmit/receive circuitry 12.

Significantly, the horn antenna 10*a* comprises a spatially and frequency dependent radio frequency (RF) attenuator 30 disposed within the horn cavity 24, such that RF energy propagating within the horn cavity 24 between the horn aperture 26 and the throat section 28 will be attenuated by the RF attenuator 30. The RF attenuator 30 comprises a graded, conical, volumetric material that is tuned to attenuate RF energy having frequencies within the operational frequency band of the horn antenna 10*a*. The RF attenuator 30 is spatially dependent in that the attenuation gradually increases for all frequencies in an outward direction towards the inner surface 22 of the horn shell 20 (and in the case where the horn antenna 10*a* is conical, in the radially outward direction), and is frequency dependent in that the attenuation gradually increases as the frequency of the RF energy increases. As a result, the attenuation of RF energy propagating through the horn cavity 24 between the throat section 28 and the horn aperture 26 more rapidly increases in the radially outward direction) as the frequency of the RF energy increases.

For example, as shown in FIG. 2, the attenuation for both low frequency RF energy and high frequency RF energy increases from the center of the RF attenuator 30 to the periphery of the RF attenuator 30. In the illustrated embodiment, the RF attenuator 30 comprises a hollow center region 32, and thus, there is no attenuation in this region. In an alternative embodiment, the RF attenuator 30 is completely solid, and as such, has at least some attenuation in the center of the RF attenuator 30. In any event, the attenuation of the high frequency RF energy increases from the center of the RF attenuator 30 (0 dB) to the periphery of the RF attenuator 30 (−50 dB) more rapidly than the attenuation of the low frequency RF energy increases from the center of the RF attenuator 30 (0 dB) to the periphery of the RF attenuator 30 (−20 dB).

It is desirable that the attenuation at the periphery of the RF attenuator 30 for the highest frequency of operation be as high as possible (optimally, infinite attenuation), and that the attenuation of the periphery of the RF attenuator 30 for the lowest frequency of operation be as low as possible (optimally, zero attenuation). Practically speaking, for a fractional frequency difference between RF energy of 1.5 (i.e., the high frequency is 1.5 times greater than the low frequency), the difference in attenuation at the periphery of the RF attenuator 30 between the high frequency RF energy and the low frequency RF energy will typically be in the range of, e.g., 10 dB (i.e., the attenuation of the high frequency RF energy is 10 dB higher than the attenuation of the low frequency RF energy at the periphery of the RF attenuator 30) to 50 dB (i.e., the attenuation of the high frequency RF energy is 50 dB higher than the attenuation of the low frequency RF energy at the periphery of the RF attenuator 30), although may be in the range, e.g., of 20 dB to 40 dB.

Thus, at higher frequencies, only a small amount of RF energy is passed to the outer region the horn aperture 26, thereby making the horn aperture 26 effectively smaller at higher frequencies, while at lower frequencies, a large amount of RF energy is passed to the outer region of the horn aperture 26, thereby making the horn aperture 26 effectively larger at lower frequencies. As a result, the effective size of the horn aperture 26 is decreased at higher frequencies, but not so much at lower frequencies. In effect, the RF attenuator 30 varies the effective size of the horn aperture 26 in inverse proportion to the frequency of the RF energy, so that, when the RF attenuator 30 is properly calibrated, the effective electrical aperture remains constant (in wavelengths) with frequency, and thus, the horn antenna 10*a* exhibits a substantially uniform beamwidth over a potentially very wide operational frequency band.

The hollow center region 32 should be substantially smaller than the desired effective aperture size at the highest frequency of the operational frequency band, since a substantial amount of attenuation is needed to reduce the physical aperture size to the effective aperture size at this highest frequency. It is preferable that the periphery of the horn aperture 26 and the cross-sectional periphery the RF attenuator 30 along a plane parallel to the horn aperture 10 be geometrically similar. For example, if the horn antenna 10*a* is conical, the cross-sections of both the horn shell 20 and RF attenuator 30 are circular, whereas if the horn antenna 10*a* is pyramidal, the cross-sections of both the horn shell 20 and RF attenuator 30 are rectangular.

In the case where the horn antenna 10*a* is intended to transmit RF signals, it is preferable that the RF attenuator 30 be composed of RF absorbing material, such that the RF energy impinging on the RF attenuator 30 have a relatively low reflection coefficient (i.e., the vast majority of the RF energy impinging on the RF attenuator 30 be either transmitted or absorbed). In this manner, very little energy will be reflected back into the transmit/receive circuitry 12 that may otherwise damage the transmit/receive circuitry 12. However, in the case where the horn antenna 10*a* is intended to only receive RF signals, the RF attenuator 30 may be composed of RF reflective material, such that RF energy impinging on the RF attenuator 30 is innocuously reflected back into space.

In the illustrated embodiment, the RF attenuator 30 is disposed within only a portion of the cavity 24, and in particular, extends to the horn aperture 26, but does not extend all the way to the throat section 28. Thus, in the illustrated embodiment, the RF attenuator 30 has a partial conical shape with the apex missing. Of course, in the case of the pyramidal horn antenna, the RF attenuator 30 will have a partial pyramidal shape with the apex missing. Ultimately, the extent that the cavity 24 is filled with the RF attenuator 30 will depend on the attenuating characteristics of the material that makes up the RF attenuator 30 at the highest operational frequency at which the horn antenna 10*a* is intended to operate. In general, the portion of the cavity 24 occupied by the RF attenuator 30 will be inversely proportional to the attenuating characteristics of the material (i.e., the greater than attenuating characteristics, the less the RF attenuator 30 occupies the cavity 24). Thus, if the attenuating characteristics of the attenuating material 28 are relatively low at the highest operational frequency, it is possible that the RF attenuator 30 entirely occupy cavity 24.

The RF attenuator 30 may be configured in any one of a variety of manners to enable the horn antenna 10*a* to have a substantially uniform beamwidth over its operational frequency band. In one embodiment, the RF attenuator 30 incrementally and discretely increases in attenuation in the radially outward direction.

Figure 3A:
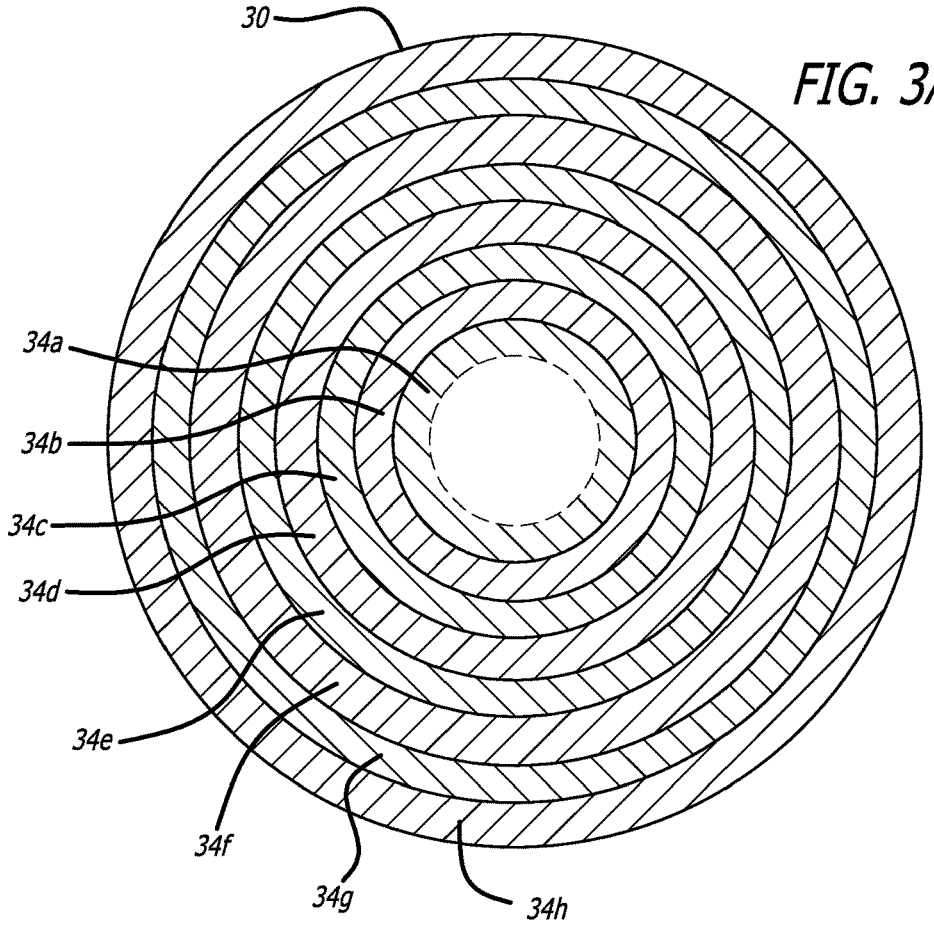
FIG. 3A is a front view of an RF attenuator used in the horn antenna of FIG. 2, particularly with FIG. 3B showing high frequency and low frequency attenuation curves exhibited by the RF attenuator.
Figure 3B:
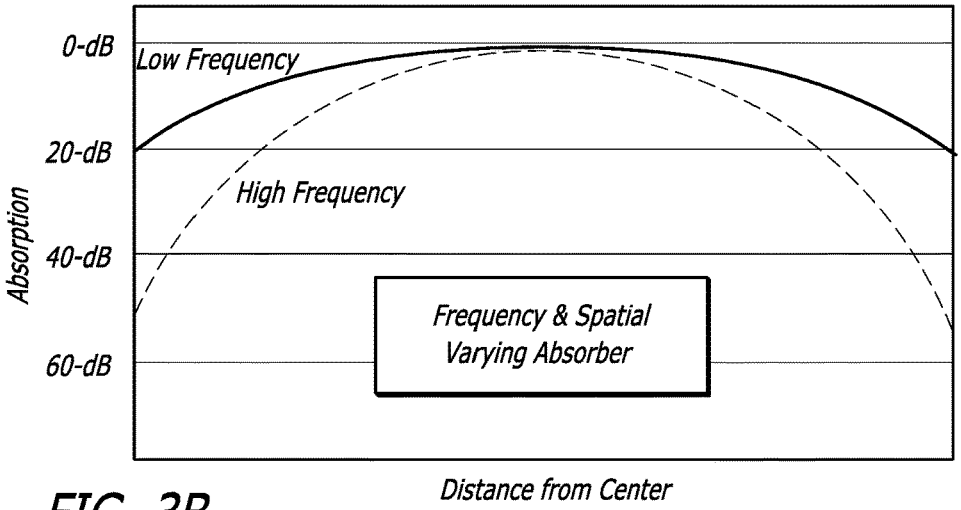

For example, referring to FIG. 3A, the RF attenuator 30 comprises a plurality of discrete attenuation regions 34*a*-34*h* that are nested in a manner, such that they incrementally increase in attenuation in the outward direction (i.e., the discrete region 34*a* has the least amount of attenuation, the discrete region 34*b* has the next greatest attenuation, the discrete region 34*c* has the next greatest attenuation, and so on, with the discrete region 34*h* having the greatest attenuation). It should be appreciated that, although the attenuation curves illustrated in FIG. 3B are continuous in nature, the attention regions 34*a*-34*h* will actually discretize these attenuation curves. In the illustrated embodiment, the discrete regions are conically-shaped that are circular in cross-section, as shown in FIG. 3A. Of course in the case of a pyramidal horn antenna, the RF attenuator will be pyramid-shaped that are rectangular in cross-section.

The attenuation characteristics of the discrete regions 32 may be varied in any one of several ways. In the embodiment illustrated in FIGS. 2 and 3, the discrete regions 32 respectively have different attenuations per unit length in order to create a positive attenuation gradient in the RF attenuator 30 in the radially outward direction. For example, the discrete regions 32 may be respectively composed of material inherently having attenuation that increases in the radially outward direction.

As one example, the discrete regions 32 may be composed of a polyurethane foam loaded with carbon powder in differing amounts to create discrete regions with different attenuations. Such material is commercially available off-the-shelf and can be used to separately create discrete regions 32, which can then be bonded to together to fabricate the RF attenuator 30.

As another example, the discrete regions 32 may be respectively composed of meta-material having attenuations that increase in the radially outward direction. Attenuating meta-material is made from an assembly of multiple elements fashioned from composite materials, such as metals or plastics; e.g., a honey-comb core material containing inductive, capacitive, and/or resistive elements. Attenuating meta-material derives its attenuation properties not from the properties of the base materials, but from the assembly of elements. The assembly of elements have a precise shape, geometry, size, and orientation to provide attenuation properties that go beyond what is possible with conventional material. The meta-material is typically arranged in repeating patterns at scales that are smaller than the wavelengths of the RF energy that it attenuates. The RF attenuator 30 may be fabricated as single integrated block of meta-material having a custom attenuation profile, or alternatively, the RF attenuator 30 may be fabricated by separately forming the discrete regions 32 from meta-material, which can then be bonded to together to fabricate the RF attenuator 30.

Another way to vary the attenuation characteristics of the discrete regions 32 is to vary the lengths of the discrete regions 32 along a plane perpendicular to the horn aperture 26. In particular, while the lengths of the discrete regions 32 illustrated in FIGS. 2 and 3 are equal, the lengths of the discrete regions 32 may be varied to create a positive attenuation gradient within the RF attenuator 30 in the radially outward direction.

Figure 4:
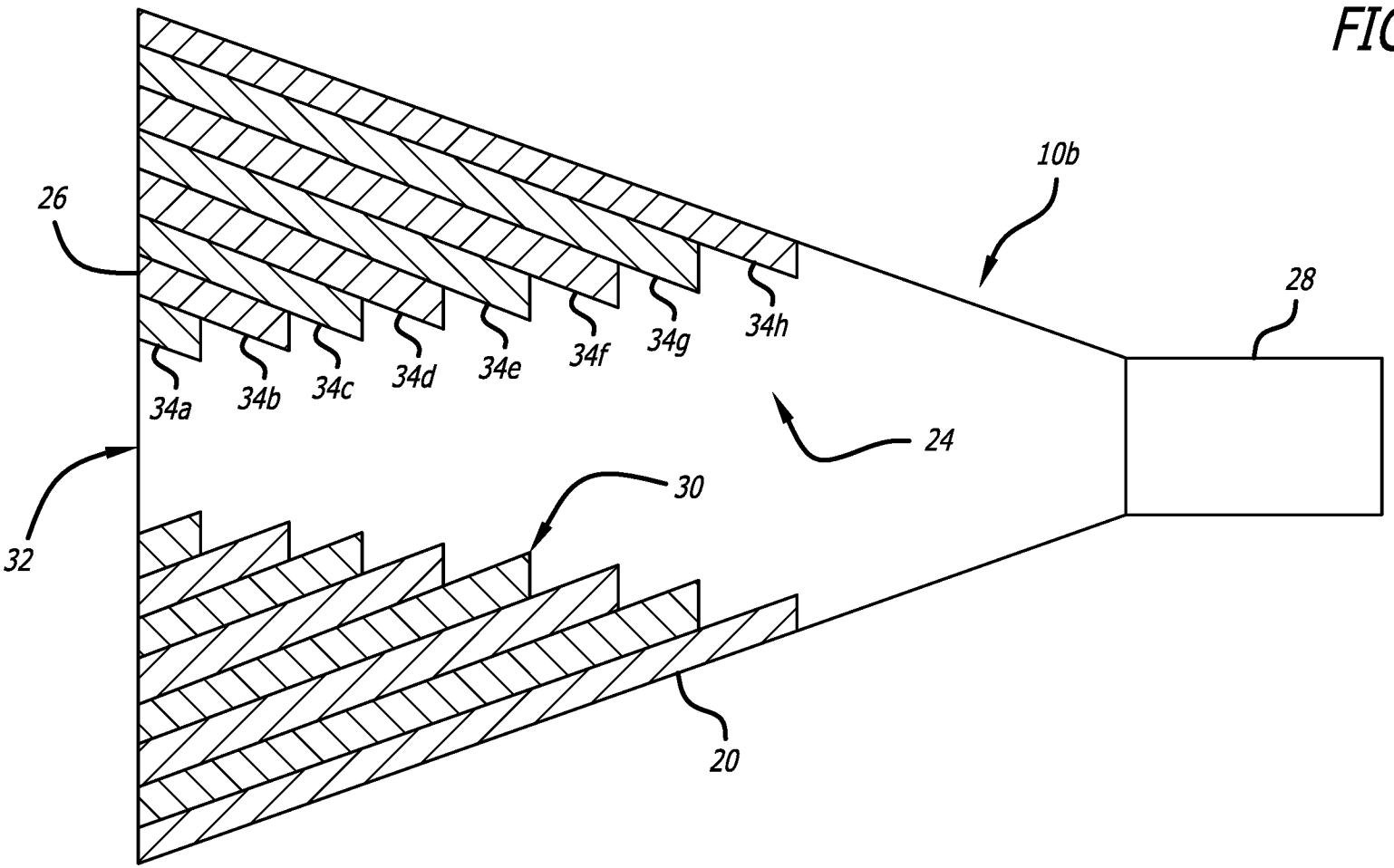
FIG. 4 is a side view of a horn antenna constructed in accordance with another embodiment of the present disclosure.

For example, with reference to FIG. 4, the attenuation characteristics of the discrete regions 32 may be varied by forming the discrete regions 32 with different lengths along a plane perpendicular to the aperture 26 of a horn antenna 10*b* that respectively increase in the radially outward direction. As shown in FIG. 4, the discrete regions 32 are arranged, such that one end of the RF attenuator 30 is completely flush at the horn aperture 26, and the opposite end of the RF attenuator 30 has a generally concave shape. That is, only the lengths of the discrete regions 32 are the side of the RF attenuator 30 facing the throat section 28 are varied.

In any event, the attenuation of a discrete region 32 will increase proportionally with the length of the discrete region 32. That is, the more material that RF energy propagates through, the more that the RF energy is attenuated. In this manner, the discrete regions 32 may respectively have the same attenuation per unit length. Thus, the entire RF attenuator 30 may be composed of a uniformly attenuating material that is predictable in nature in that its attenuation may be computed as a function of dB/in. For example, a two-inch length of material will have twice the attenuation as a one-inch length of material. The RF attenuator 30 may be fabricated as a single integrated block of the uniformly attenuating material or may be fabricated by separately forming the discrete regions 32 from the uniformly attenuating material, which can then be bonded to together to fabricate the RF attenuator 30.

Figure 5:
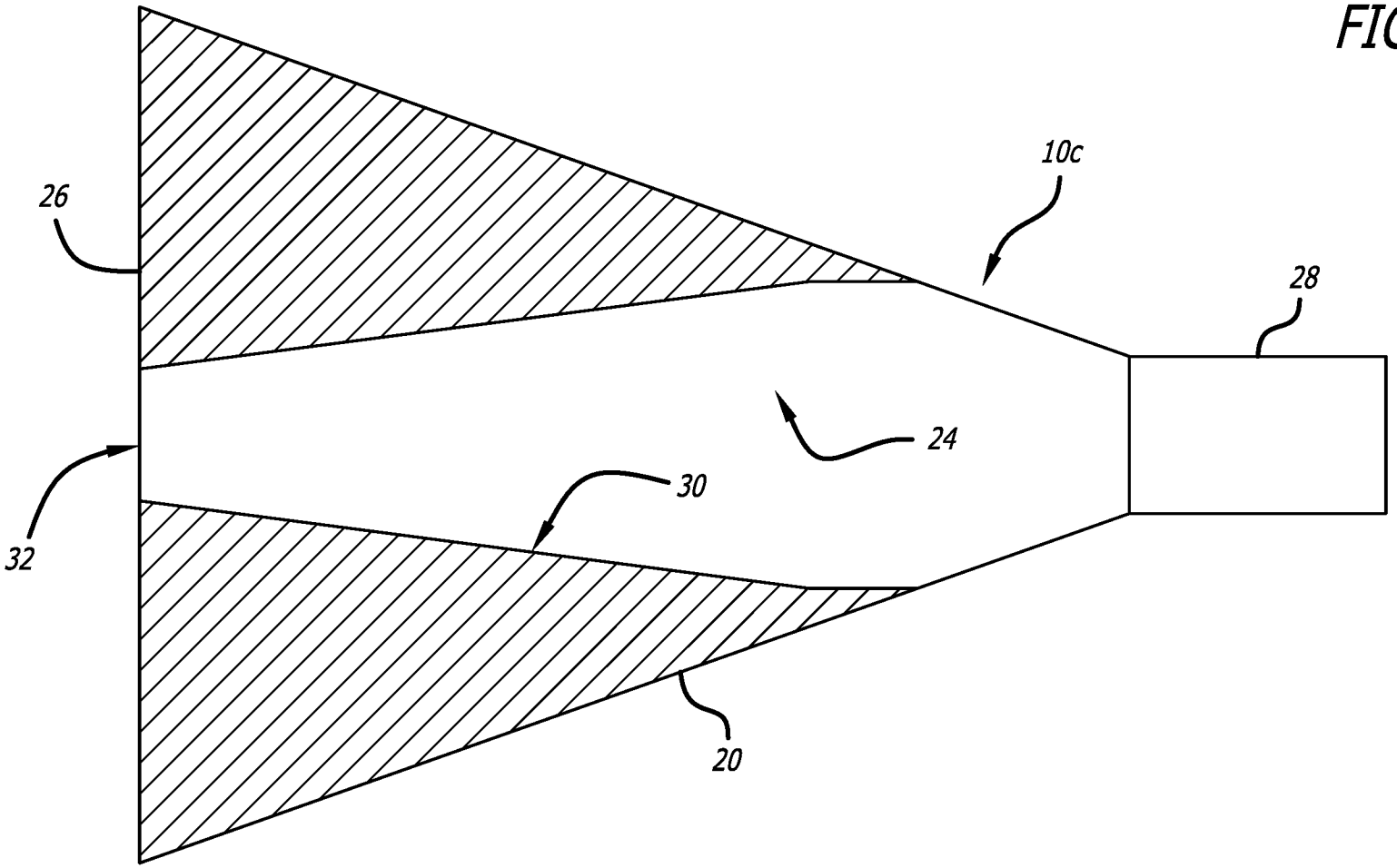
FIG. 5 is a side view of a horn antenna constructed in accordance with still another embodiment of the present disclosure.

Although the RF attenuator 30 in FIGS. 2-4 has been described as having an attenuation that incrementally and discretely increases in the radially outward direction, it should be appreciated that the attenuation of the RF attenuator 30 may continuously increase in the radially outward direction. For example, as shown in FIG. 5, the RF attenuator 30 of a horn antenna 10*c* does not comprise discrete regions with discrete attenuating characteristics, but rather, exhibits an attenuation that continuously increases in the radially outward direction. To this end, the end of the RF attenuator 30 facing the throat section 28 continuously tapers down from the outer edge to the center of the RF attenuator 30.

Regardless of the type and arrangement of material used for the RF attenuator 30, the material will generally be predictably frequency-dependent, since the attenuation of material is a function of how many wavelengths are in the length of material. For example, a one-inch length of material would have twice the attenuation at 10 GHz as it would at 5 GHz.

In general, trade-offs must be made between beamwidth uniformity, frequency bandwidth, and antenna gain when designing the horn antenna 10. In general, beamwidth uniformity, frequency bandwidth, and antenna gain are competing parameters that are preferably balanced to attach the optimize performance from the horn antenna 10. For example, the larger the frequency bandwidth, the more the beamwidth becomes non-uniform over the operational frequency band, and thus, the more that the RF energy must be attenuated at higher end of the operational frequency band to make the beamwidth uniform over the operational frequency band. The more that the RF energy is attenuated (especially at the higher end of the bandwidth), the less gain the horn antenna 10*a* will have.

It can be appreciated from the foregoing that the use of the RF attenuator 30 decreases a variance of the beamwidth of the horn antenna 10 over any operational frequency band relative to a nominal beamwidth of corresponding horn antenna 10 without the RF attenuator 30. As a practical example, the variance of the beamwidth for a conventional horn antenna may be greater than 20% over an operational frequency band having a 2:1 bandwidth, greater than 100% over an operational frequency band having a 4:1 bandwidth, and greater than 500% over an operational frequency band having a 10:1 bandwidth, whereas the variance of the beamwidth of the horn antenna 10 may be less than 5% over an operational frequency band having a 2:1 bandwidth, less than 10% over an operational frequency band having a 4:1 bandwidth, and less than 20% over an operational frequency band having a 20:1 bandwidth. As the frequency bandwidth increases, the horn antenna 10 will have an increased gain loss relative to the conventional horn antenna, up 3-4 dB in extreme cases at the higher end of the bandwidth. However, this loss of gain will generally be a worthy trade-off to achieve a substantially uniform beamwidth, so that the radiation pattern will be substantially the same over the entire operational frequency band.

Although the horn antenna 10, due to its ability to have a substantially uniform beamwidth over its operational frequency band, lends itself well to communication applications without the use of a reflector, it should be appreciated that the horn antenna 10 may be used in a Cassegrain reflector systems that require constant beamwidth feeds to get maximum gain. Currently, the fractional bandwidth of Cassegrain reflector systems is limited to 50% due to the large variance in the beamwidth. The incorporation of the horn antenna 10 into a Cassegrain reflector system will allow the bandwidth of the Cassegrain reflector system to be increased. Furthermore, the horn antenna 10 may be used in systems other than communications systems. For example, the horn antenna 10 may be used in surveillance radar to minimize side lobes over a broad frequency range. Such side lobes are typically created from the diffraction of the RF energy on the edges of the reflector. As the frequency is decreased, more RF energy radiates the edges of the reflector, thereby increasing the side lobes. Thus, the lower end of the bandwidth of the surveillance radar is limited. The incorporation of the horn antenna 10 into surveillance radar systems will allow the bandwidth of the surveillance radar system to be increased.

Figure 6:
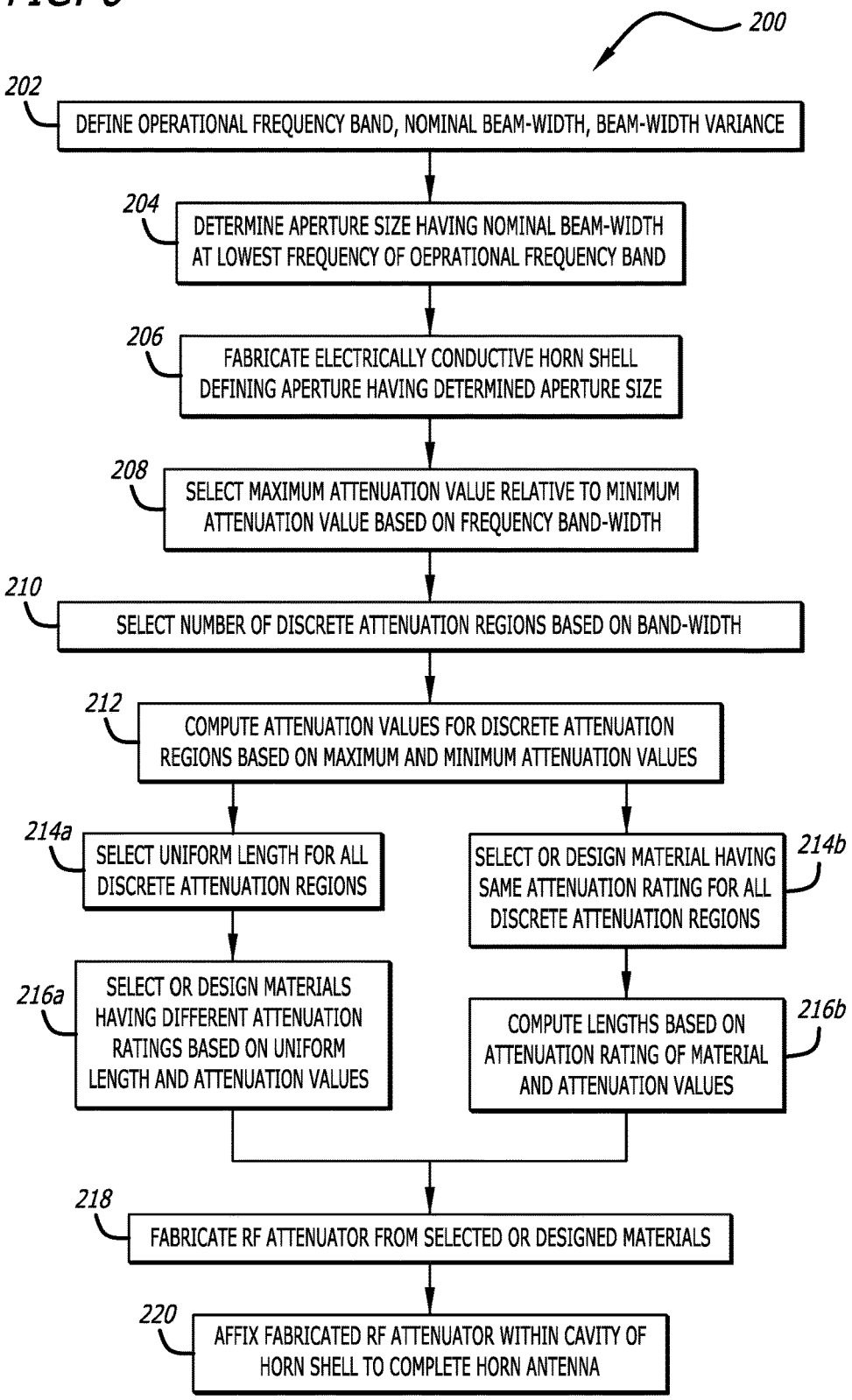
FIG. 6 is a flow diagram illustrating one method of manufacturing the horn antennas of FIG. 2-5.

Having described the structure and function of the horn antenna 10, one method 200 of manufacturing the horn antennas 10 illustrated in FIGS. 2-4 will now be described with respect to FIG. 6. First, performance requirements defining an operational frequency band (e.g., 1 GHz-10 GHz), nominal beamwidth (e.g., 35%), and variance from the nominal beamwidth over the operational frequency band (e.g., less than 10% (±5%)) are specified (step 202). Next, an aperture size of the horn antenna 10 exhibiting the nominal beamwidth at a first frequency within the operational frequency band is determined in a conventional manner (step 204). In the preferred embodiment, the first frequency is selected to be the lowest frequency of the operational frequency band (e.g., 1 GHz). Next, an electrically conductive horn shell 20 defining an aperture having the determined aperture size is fabricated in a conventional manner (step 206). The electrically conductive horn shell 20 may be, e.g., conical, pyramidal, sectoral, profiled, etc., and may have a smooth inner surface.

As discussed above with respect to FIGS. 2 and 3A, the RF attenuator 30 will be fabricated in a manner that the attenuation incrementally and discretely increases in the radially outward direction, and in particular, will be fabricated with a plurality of discrete regions 34 that incrementally and discretely increase in attenuation in the radially outward direction. Thus, the number and attenuation characteristics of the discrete regions 34 will need to be selected.

In particular, a maximum attenuation value relative to a minimum attenuation value is selected based on the width of the operational frequency band (step 208). In general, the wider the bandwidth the greater the difference between the maximum and minimum attenuation values is required to make the beamwidth uniform over the operational frequency band. The maximum attenuation value will preferably be selected to provide a satisfactory balance between uniformity in the beamwidth over the operational frequency band and gain loss. Thus, selection of the maximum attenuation value must be balanced against the loss of gain resulting from attenuation, and therefore, the attenuation of the RF attenuator 30 should be limited in that respect. In general, the minimum attenuation value should be zero, in which case, there will be no attenuation in the center of the horn antenna 10, and thus, the RF attenuator 30 will have a hollow center region 32. Next, the number of discrete attenuation regions 34 is selected based on the width of the operational frequency band (step 210). Notably, the larger the width of the operational frequency band, the greater the number of discrete attenuation regions. As a general rule, a discrete attenuation region for each 25% fractional bandwidth should be included. However, due to manufacturing considerations, the number of discrete attenuation regions 34 should be limited to a reasonable number.

Next, the attenuation values for the discrete attenuation regions 34 at a nominal frequency within the operational frequency band (e.g., the center frequency) are respectively computed from the maximum and minimum attenuation values (step 212). The attenuation value for the outermost discrete attenuation region 34 will correspond to the maximum attenuation value determined above in step 208, whereas the attenuation values for the remaining discrete attenuation regions 34 can determine to discretely vary from the maximum attenuation value to the minimum attenuation value (typically, zero) in a linear fashion. For example, if the maximum attenuation value attenuation is −2 dB, the minimum attenuation value is 0 dB, and the total number of discrete attenuation regions 34 equals eight, the attenuation values for the discrete attenuation regions will be −0.25 dB, −0.50 dB, −0.75 dB, −1.00 dB, −1.25 dB, −1.50 dB, −1.75 dB, and −2.00 dB for the respective eight discrete attenuation regions 34.

Next, a uniform length of the discrete attenuation regions 34 is selected for the discrete attenuation regions 34 (step 214*a*), and RF attenuation materials having different attenuation ratings (i.e., attenuation per unit length) are respectively selected or designed based on the attenuation values computed at the nominal frequency for the discrete attenuation regions 34 of the uniform length (step 216*a*). A specific RF attenuation material for a respective discrete attenuation region 34 can be selected or designed using a very simple formula involving the attenuation value and length selected for that discrete attenuation region 34 at the nominal frequency. For example, if the computed attenuation value is −1.5 dB, and the length is 5 inches, for a discrete attenuation region 34, the selected or designed RF attenuation material for that discrete attenuation region 34 should have an attenuation rating of −1.5/5=−0.30 dB/inch at the nominal frequency.

Alternatively, RF attenuation material having the same attenuation per unit length for the discrete attenuation regions 34 is selected or designed (step 214*b*), and different lengths for the discrete attenuation regions 34 are respectively computed based on the selected attenuation values and the attenuation per unit length for the discrete attenuation regions 34 (step 216*b*). A length for a respective discrete attenuation region 34 can be computed using a very simple formula involving the attenuation value selected for each discrete attenuation region 34 and the attenuation rating of the designed or selected RF attenuation material at the nominal frequency. For example, if the computed attenuation value is −1.0 dB, and the attenuation rating of the RF attenuation material is −0.5 dB/inch, for a discrete attenuation region 34, the length of that discrete attenuation region 34 should be (−1.0 dB)÷(−0.5 dB/inch)=2 inches.

In either case, the RF attenuation material selected or designed for the discrete attenuation regions 34 may be an RF absorbing material (especially if the horn antenna 10 is intended to transmit RF energy) or RF reflective material (e.g., if the horn antenna 10 is intended to only receive RF energy). The RF attenuation material can be selected from commercially available material (e.g., carbon powder loaded polyurethane material) or custom-designed meta-material (e.g., honey-comb core material containing inductive, capacitive, and/or resistive elements).

Next, an RF attenuator 30 having an attenuation that gradually increases from its innermost region to its outermost region is fabricated from the selected or designed RF attenuation materials (step 218). The RF attenuator 30 may be fabricated as single integrated block having the discrete attenuation regions 34, or alternatively, the RF attenuator 30 may be fabricated by separately forming the discrete regions 34 from RF attenuation materials, which can then be bonded to together to fabricate the RF attenuator 30. Preferably, the periphery of the fabricated RF attenuator 30 conforms to the inner surface of the electrically conductive shell 20. This can be accomplished simply by making the periphery of the RF attenuator 30 geometrically similar to the aperture 26. In the alternative embodiment of the horn antenna 10 illustrated in FIG. 5 where the RF attenuator 30 continuously increases in attenuation in the outward direction, the RF attenuator 30 may be fabricated as a single integrated block of material, the attenuation of which will inherently vary due to the continuous tapering of the RF attenuator 30.

Lastly, the fabricated RF attenuator 30 is affixed (e.g., by bonding) within the cavity 24 of the electrically conductive shell 20 to complete the horn antenna 10, such that the variance of a nominal beamwidth of the horn antenna over the operational frequency band complies with the minimum allowable variance from the nominal beamwidth (step 220). The minimum allowable variance from the nominal beamwidth will preferably be defined, such that the RF attenuator will be fabricated in a manner that decreases a variance of the beamwidth of the horn antenna 10 over the operational frequency band relative to a nominal beamwidth of corresponding horn antenna without the RF attenuator. The preferable result is that the horn antenna 10 has a beamwidth that is substantially uniform over the operational frequency band (e.g., less than 20%).

Although certain illustrative embodiments and methods have been disclosed herein, it can be apparent from the foregoing disclosure to those skilled in the art that variations and modifications of such embodiments and methods can be made without departing from the true spirit and scope of the art disclosed. Many other examples of the art disclosed exist, each differing from others in matters of detail only. Accordingly, it is intended that the art disclosed shall be limited only to the extent required by the appended claims and the rules and principles of applicable law.

We claim:

1. A horn antenna, comprising:

an electrically conductive shell having an inner surface;

a cavity formed in the shell;

an aperture defined at one end of the cavity;

a throat section coupled to the electrically conductive shell in communication with another end of the cavity opposite the aperture; and a spatially and frequency dependent radio frequency (RF) attenuator disposed within the cavity starting at the aperture, such that an attenuation of RF energy propagating through the cavity between the throat section and the aperture more rapidly increases in an outward direction towards the inner surface of the electrically conductive shell as the frequency of the RF energy increases, wherein the RF attenuator comprises a plurality of discrete regions that are nested in a manner, such that they incrementally increase in attenuation in the outward direction, and wherein the horn antenna has a beamwidth that is substantially uniform over an operational frequency band.

2. The horn antenna of claim 1, wherein the RF attenuator varies an electrically effective size of the aperture in inverse proportion to a frequency of the RF energy.

3. The horn antenna of claim 1, wherein the RF attenuator incrementally and discretely increases in attenuation in the outward direction.

4. The horn antenna of claim 1, wherein the discrete regions respectively have different attenuations per unit length.

5. The horn antenna of claim 1, wherein the discrete regions have lengths along a plane perpendicular to the aperture that respectively increase in the outward direction.

6. The horn antenna of claim 1, wherein the RF attenuator continuously increases in attenuation in the outward direction.

7. The horn antenna of claim 1, wherein the RF attenuator decreases a variance of a beamwidth of the horn antenna over an operational frequency band relative to a nominal beamwidth of corresponding horn antenna without the RF attenuator.

8. A radio frequency (RF) system, comprising:

a horn antenna, comprising:

an electrically conductive shell having an inner surface;

a cavity formed in the shell;

an aperture defined at one end of the cavity;

a throat section coupled to the electrically conductive shell in communication with another end of the cavity opposite the aperture; and a spatially and frequency dependent radio frequency (RF) attenuator disposed within the cavity starting at the aperture, such that an attenuation of RF energy propagating through the cavity between the throat section and the aperture more rapidly increases in an outward direction towards the inner surface of the electrically conductive shell as the frequency of the RF energy increases, wherein the RF attenuator comprises a plurality of discrete regions that are nested in a manner, such that they incrementally increase in attenuation in the outward direction, and wherein the horn antenna has a beamwidth that is substantially uniform over an operational frequency band;

a RF circuitry coupled to the throat section of the horn antenna, and the RF circuitry transmitting the RF energy to the horn antenna and/or receiving RF energy from the horn antenna.

9. A communications system, comprising:

a structural body; and the RF system of claim 8 mounted to the structural body.

10. The system of claim 8, wherein the RF attenuator varies an electrically effective size of the aperture in inverse proportion to a frequency of the RF energy.

11. The system of claim 8, wherein the RF attenuator incrementally and discretely increases in attenuation in the outward direction.

12. The system of claim 8, wherein the discrete regions respectively have different attenuations per unit length.

13. A method of manufacturing a horn antenna in accordance with performance requirements defining an operational frequency band and a nominal beamwidth, and a minimum allowable variance from the nominal beamwidth, comprising:

determining an aperture size of the horn antenna exhibiting the nominal beamwidth at a first frequency within the operational frequency band;

fabricating an electrically conductive shell having a cavity and defining an aperture having the determined aperture size;

fabricating an RF attenuator having an attenuation that gradually increases from an innermost region of the RF attenuator to an outermost region of the RF attenuator, an outer periphery of the RF attenuator conforming to an inner surface of the electrically conductive shell, wherein the RF attenuator is fabricated with a plurality of discrete regions that are nested, such that they incrementally and discretely increase in attenuation in the outward direction; and affixing the RF attenuator within the cavity starting at the aperture of the electrically conductive shell, such that the variance of a nominal beamwidth of the horn antenna over the operational frequency band complies with the minimum allowable variance from the nominal beamwidth, wherein the horn antenna has a beamwidth that is substantially uniform over an operational frequency band.

14. The method of claim 13, wherein the RF attenuator is fabricated such that an electrically effective size of the aperture varies in inverse proportion to frequency.

15. The method of claim 13, wherein the RF attenuator is fabricated in a manner that the attenuation incrementally and discretely increases in the outward direction.

16. The method of claim 13, further comprising:

respectively selecting different attenuation values for the discrete regions;

respectively selecting or designing materials having different attenuations per unit length based on the different selected attenuation values; and respectively fabricating the discrete regions from the materials.

17. The method of claim 13, further comprising:

respectively selecting different attenuation values for the discrete regions;

selecting or designing an attenuating material having an attenuation per unit length;

respectively computing lengths of the attenuating material based on the different selected attenuation values and the attenuation per unit length of the attenuating material; and respectively fabricating the discrete regions from the attenuating material, the discrete regions having lengths equal to the computed lengths along a plane perpendicular to the aperture that respectively increase in the outward direction.

18. The method of claim 13, wherein the RF attenuator continuously increases in attenuation in the outward direction.

19. The method of claim 13, wherein the horn antenna has a beamwidth that is substantially uniform over the operational frequency band.

20. The method of claim 13, wherein the RF attenuator decreases a variance of a beamwidth of the horn antenna over the operational frequency band relative to a nominal beamwidth of corresponding horn antenna without the RF attenuator.

* * * * *